US009588460B2

(12) United States Patent
Kasai et al.

(10) Patent No.: US 9,588,460 B2
(45) Date of Patent: Mar. 7, 2017

(54) IMAGE FORMING APPARATUS

(71) Applicants: Tadashi Kasai, Kanagawa (JP); Jun Hitosugi, Tokyo (JP); Kunio Hasegawa, Kanagawa (JP); Takamasa Ozeki, Kanagawa (JP); Emiko Shiraishi, Tokyo (JP); Wakana Itoh, Kanagawa (JP); Makoto Yasuda, Kanagawa (JP); Mutsuki Morinaga, Kanagawa (JP); Hitoshi Yamamoto, Kanagawa (JP)

(72) Inventors: Tadashi Kasai, Kanagawa (JP); Jun Hitosugi, Tokyo (JP); Kunio Hasegawa, Kanagawa (JP); Takamasa Ozeki, Kanagawa (JP); Emiko Shiraishi, Tokyo (JP); Wakana Itoh, Kanagawa (JP); Makoto Yasuda, Kanagawa (JP); Mutsuki Morinaga, Kanagawa (JP); Hitoshi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/936,042

(22) Filed: Nov. 9, 2015

(65) Prior Publication Data

US 2016/0139537 A1 May 19, 2016

(30) Foreign Application Priority Data

Nov. 13, 2014 (JP) ..... 2014-230893

(51) Int. Cl.
*G03G 15/00* (2006.01)
*G03G 15/08* (2006.01)

(52) U.S. Cl.
CPC ..... *G03G 15/0863* (2013.01); *G03G 15/0879* (2013.01)

(58) Field of Classification Search
CPC ..... G03G 15/0863; G03G 15/0877; G03G 15/0867; G03G 15/55; G03G 15/556
(Continued)

(56) References Cited

U.S. PATENT DOCUMENTS 5,893,005 A * 4/1999 Ogura ..... G06F 11/0733 399/11
2005/0254841 A1* 11/2005 Tomitaka ..... G03G 15/0872 399/12
(Continued)

FOREIGN PATENT DOCUMENTS

JP 2008-151971 7/2008
JP 2009-008756 1/2009
(Continued)

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

An image forming apparatus includes a latent image bearer, a developing device, a toner container, a toner feed connector, a processor, and a notifier. The developing device develops, with toner, a latent image on the latent image bearer. The toner container contains the toner. The toner container is detachably attachable to the image forming apparatus. The toner feed connector guides the toner of the toner container to the developing device. The information detector detects identification information including toner type information and maintenance contract information stored in the toner container. The processor determines whether the toner type information of the toner container coincides before and after replacement and whether the maintenance contract information of the toner container is matched with maintenance contract information of the image forming apparatus. The notifier indicates a determination made by the processor.

12 Claims, 12 Drawing Sheets

(58) Field of Classification Search
USPC ..... 399/11–13
See application file for complete search history.

(56) References Cited

U.S. PATENT DOCUMENTS

| | | | |
|---|---|---|---|
| 2009/0220266 | A1 | 9/2009 | Shiraishi et al. |
| 2011/0194863 | A1 | 8/2011 | Matsumoto et al. |
| 2013/0278943 | A1 | 10/2013 | Kurosawa et al. |
| 2015/0037049 | A1 | 2/2015 | Shiraishi et al. |
| 2015/0050033 | A1 | 2/2015 | Kasai et al. |

FOREIGN PATENT DOCUMENTS

| | | |
|---|---|---|
| JP | 2010-066473 | 3/2010 |
| JP | 2013-073031 | 4/2013 |
| WO | WO2015/104931 A1 | 7/2015 |

* cited by examiner

IMAGE FORMING APPARATUS

CROSS-REFERENCE TO RELATED APPLICATION

The present application claims priority pursuant to 35 U.S.C. §119(a) from Japanese patent application number 2014-230893, filed on Nov. 13, 2015, the entire disclosure of which is incorporated by reference herein.

BACKGROUND

Technical Field

Exemplary embodiments of the present invention relates to an image forming apparatus.

Background Art

Image forming apparatuses employing electrophotography, such as printers and copiers, include a latent image bearer, a developing device, and a plurality of toner containers disposed in the apparatus, in which a latent image formed on the latent image bearer is developed by the developing device, toner is replenished from the plurality of toner containers, and each of the toner containers is removably installable in the apparatus.

So-called CMYK process color toner, each different in color, from cyan (C), magenta (M), yellow (Y), to black (K), is contained in the respective toner container.

For example, in an image forming apparatus, maintenance contract status of each toner container can be verified. Specifically, the maintenance contract status data is stored in a memory device of the apparatus body and in a memory of each toner container. When the toner container is attached to the apparatus body, all data related to the maintenance contract status stored in both memories is compared, and when the data is not coincident with each other, use of the subject toner container is prohibited.

SUMMARY

In one embodiment of the disclosure, provided is an image forming apparatus that includes a latent image bearer; a developing device to develop, with toner, a latent image on the latent image bearer; a toner container that contains the toner, the toner container being detachably attachable to the image forming apparatus; a toner feed connector to guide the toner of the toner container to the developing device; an information detector to detect identification information including toner type information and maintenance contract information stored in the toner container; a processor to determine whether the toner type information of the toner container coincides before and after replacement and whether the maintenance contract information of the toner container is matched with maintenance contract information of the image forming apparatus; and a notifier to indicate a determination made by the processor.

These and other objects, features, and advantages of the present invention will become apparent upon consideration of the following description of the preferred embodiments of the present invention when taken in conjunction with the accompanying drawings.

DETAILED DESCRIPTION

Hereinafter, an embodiment of an image forming apparatus will be described referring to accompanying drawings.

Figure 1:
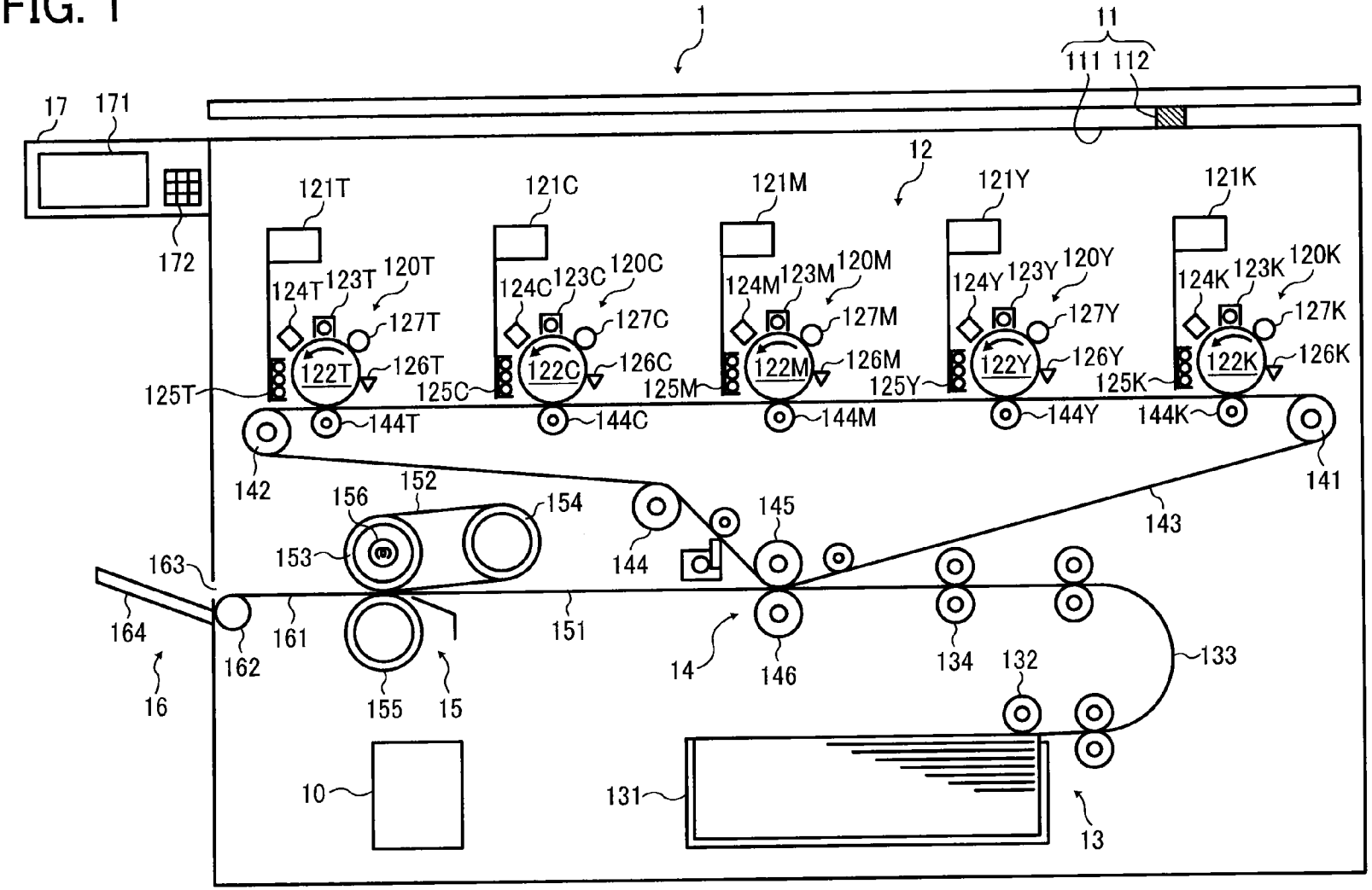
FIG. 1 illustrates a schematic configuration of an image forming apparatus according to an embodiment of the present invention.

FIG. 1 illustrates a schematic configuration of an image forming apparatus 1 according to an embodiment of the present invention.

As illustrated in FIG. 1, the image forming apparatus 1 includes a control unit 10, an image reader 11, an image forming section 12, a sheet feeder section 13, a transfer section 14, a fixing section 15, a discharging section 16, and a console 17.

The image reader 11 generates image data by optically reading the image written on a sheet of paper (hereinafter, simply as a sheet). Specifically, light is directed onto the sheet and the reflected light is received by a sensor such as a charge-coupled device (CCD) or a contact image sensor (CIS), thereby reading image data. The image data is information representing an image to be formed on the recording medium such as a sheet and is represented using electrical color-decomposed image signals showing red (R), green (G), and blue (B) colors.

The image reader 11 includes a contact glass 111 and a sensor 112 as illustrated in FIG. 1. The sheet of paper carrying an image thereon is placed on the contact glass 111. The sensor 112 reads out image data of the image carried on the sheet placed on the contact glass 111. The image forming section 12 forms a toner image on a surface of an intermediate transfer belt 143 included in the transfer section 14 by adhering toner on the surface thereof based on the image data read by the image reader 11 or the image data received via a network I/F 102. The image forming section 12 includes image forming units 120C, 120M, 120Y, 120K, and

120T each forming a toner image of each color of cyan (C), magenta (M), yellow (Y), black (K), and clear (T), respectively.

Hereinafter, any one of the C-color toner, M-color toner, Y-color toner, and K-color toner will be denoted as process color toner. Each process color toner is formed of electrically chargeable resin particles including a colorant, such as a pigment or dye. On the other hand, the T-color toner is a special color toner. The special color toner includes various types including orange, violet, green, light black, fluorescence, clear (or transparent), white, black, metallic (or metal color), and the like. By overlaying the special color toner on the process color toner on the sheet, various representations can be possible.

Next, the image forming unit 120 will be described. The image forming unit of each color of C, M, Y, K, and T is configured to be the same except that the color of toner used is different. As a result, suffixes such as C, M, Y, K, and T in the reference numerals are appropriately omitted in the following description.

The image forming unit 120 includes a toner bottle 121 as a toner container, a photoconductor drum 122 as an image bearer, a charger 123, an exposure device 124, a developing device 125, a discharger 126, and a cleaner 127. The toner bottle 121 contains toner with respective colors. The toner bottle 121 can be accommodated in a toner container holder formed in the image forming apparatus. A predetermined amount of toner is replenished from the toner bottle to the developing device 125.

Each of the toner bottles 121C, 121M, 121Y, and 121K of process color toner is connected to a portion immediately above the corresponding one of the developing devices 125C, 125M, 125Y, and 125K via a supply tube. The toner falling down from the toner bottles 121C, 121M, 121Y, and 121K of the process color toner is replenished to the developing devices 125C, 125M, 125Y, and 125K via the supply tube. With such a configuration, the image forming apparatus can be made compact.

A special color toner bottle 121T is connected to the developing device 125T via a toner feeder, such as a diaphragm pump 183T and a sub hopper 182T in addition to the supply tube 181T. The special color toner inside the toner bottle 121T is replenished to the developing device 125T by a pressure from the diaphragm pump 183T. As configured above, the toner bottle 121T including the special color toner is allowed to be placed freely without regarding the position of the developing device 125T.

For example, if the image forming apparatus 1 includes a scanner, the scanner is in general mounted on the top of the image forming apparatus 1 for users' convenience. Further, to make the image forming apparatus 1 more compact, the toner bottles 121C, 121M, 121Y, and 121K of the process color toner are sequentially and serially disposed along the side of the scanner. Further, the toner bottle 121T of the special color toner is disposed below the toner bottle 121K.

When the toner bottle 121T of the special color toner is disposed below the toner bottle 121K, the toner bottle 121T is not easily affected by the heat from the fixing section 15. With this structure, the special color toner included in the toner bottle 121T of the special color toner is prevented from degrading. Further, by disposing the toner bottle 121T at a position away from the row of the toner bottles 121C, 121M, 121Y, and 121K of the process color toner, it can be prevented for a user to position the toner bottle 121T of the special color toner at a wrong position.

A surface of the photoconductor drum 122C is charged by the charger 123C uniformly. An electrostatic latent image is formed on the charged surface of the photoconductor drum 122 by the exposure device 124 based on image data received from the control unit 10. The developing device 125 adheres toner on the surface of the photoconductor drum 122 on which the electrostatic latent image is formed, thereby forming a toner image on the surface of the photoconductor drum 122. An intermediate transfer belt 143 is so disposed as to contact the photoconductor drum 122, and thereby rotates in the same direction as that of the photoconductor drum 122.

The charger 123 uniformly charges the surface of the photoconductor drum 122. The exposure device 124 radiates light, based on a halftone dot area ratio determined by the control unit 10, to the surface of the photoconductor drum 122 charged by the charger 123, thereby forming the electrostatic latent image. The developing device 125 adheres each color toner contained in the developer container or the toner bottle 121 to the electrostatic latent image formed by the exposure device 124 on the surface of the photoconductor drum 122, so that the electrostatic latent image is developed and a toner image is formed. The discharger 126 electrically neutralizes the surface of the photoconductor drum 122 after the toner image is transferred to the intermediate transfer belt 143. The cleaner 127 removes residual toner remaining on the photoconductor drum 122 neutralized by the discharger 126.

The image forming unit 120T of the special color toner is disposed most upstream of the intermediate transfer belt 143 in the conveyance direction, relative to the image forming units 120C, 120M, 120Y, and 120K of the process color toner. With this structure, because the special color toner is transferred on a surface layer than the process color toner in a printed matter, a value-added printed matter can be generated featuring in the special color toner.

The sheet feeder section 13 supplies sheets to the transfer section 14. The sheet feeder section 13 includes a sheet container 131, a sheet feed roller 132, a sheet feed belt 133, and a registration roller pair 134. The sheet container 131 contains the sheet. The sheet feed roller 132 is disposed rotatably to move the sheet contained in the sheet container 131 toward the sheet feed belt 133.

The sheet feed roller 132 is configured to pull a topmost sheet one by one from the sheet stack and place the sheet on the sheet feed belt 133. The sheet feed belt 133 conveys each separated sheet by the sheet feed roller 132 to the transfer section 14. The registration roller pair 134 sends the sheet conveyed by the sheet feed belt 133, to the transfer section 14 at a timing when the toner image formed on the intermediate transfer belt 143 arrives at the transfer section 14, which will be described later.

The transfer section 14 transfers an image formed on the photoconductor drum 122 by the image forming section 12 onto the intermediate transfer belt 143 (i.e., a primary transfer process), and then, the transfer section 14 transfers the image that has been transferred to the intermediate transfer belt 143, onto the sheet (i.e., a secondary transfer process). The transfer section 14 includes a drive roller 141, a driven roller 142, the intermediate transfer belt 143, primary transfer rollers 144C, 144M, 144Y, 144K, and 144T, a secondary transfer roller 145, and a secondary transfer counter roller 146.

The intermediate transfer belt 143 is entrained around the drive roller 141 and the driven roller 142. Thus, when the drive roller 141 is driven and rotates, the intermediate transfer belt 143 entrained around the drive roller 141 rotates as well. The intermediate transfer belt 143 is entrained around the drive roller 141 and the driven roller 142. The driven roller 142 rotates together when the drive roller 141 rotates and the intermediate transfer belt 143 moves.

The intermediate transfer belt 143 is entrained around the drive roller 141 and the driven roller 142 and moves while contacting the photoconductor drum 122 as the drive roller 141 rotates. Because the intermediate transfer belt 143 moves while contacting the photoconductor drum 122, the image formed on the photoconductor drum 122 is transferred to the surface of the intermediate transfer belt 143. The primary transfer rollers 144C, 144M, 144Y, 144K, and 144T are disposed opposite the photoconductor drums 122C, 122M, 122Y, 122K, and 122T, respectively, with the photoconductor drums 122C, 122M, 122Y, 122K, and 122T sandwiched in between and rotate to move the intermediate transfer belt 143. A secondary transfer roller 145 sandwiches the intermediate transfer belt 143 and the sheet, together with the secondary transfer counter roller 146 to thus form a secondary transfer nip.

The fixing section 15 fixes the toner transferred onto the sheet by the transfer section 14. The term "fixing" used herein means that the resinous component of toner is fused onto the sheet by applying heat and pressure to the toner on the sheet. The toner transferred onto the sheet by the transfer section 14 is subjected to the fixing process by the transfer section 14, so that the toner on the sheet turns into a stabilized state. The fixing section 15 includes a conveyance belt 151, a fixing belt 152, a fixing roller 153, a fixing belt conveyance roller 154, a fixing counter roller 155, and a heat generator 156.

The sheet conveyance belt 151 conveys the sheet on which the toner image is transferred in the transfer section 14, toward the fixing roller 153 and the fixing counter roller 155. The fixing belt 152 is entrained around the fixing roller 153 and the fixing belt conveyance roller 154 and rotates driven by the above rollers 153 and 154. The fixing roller 153 and the fixing counter roller 155 disposed opposite the fixing roller 153 sandwich the sheet conveyed along the conveyance belt 151, so that the sheet is heated and pressed between the fixing roller 153 and the fixing counter roller 155.

The fixing belt 152 is wound around the fixing belt conveyance roller 154 together with the fixing roller 153, and when the fixing belt conveyance roller 154 rotates, the fixing belt 152 rotates together with the fixing belt conveyance roller 154. The fixing counter roller 155 is disposed opposite the fixing roller 153 and sandwiches the conveyed sheet between the fixing roller 153 and the fixing counter roller 155 via the fixing belt 152. The heat generator 156 disposed inside the fixing roller 153 generates heat and heats the sheet via the fixing roller 153.

The discharging section 16 discharges the sheet on which the toner image is fixed in the fixing section 15, from the image forming apparatus 1, and includes a sheet discharge belt 161, a sheet discharge roller 162, a sheet discharge port 163, and a sheet container 164. The sheet discharge belt 161 conveys the sheet processed in the fixing section 15 toward the sheet discharge port 163. The sheet discharge roller 162 discharges the sheet conveyed by the sheet discharge belt 161 through the sheet discharge port 163 and the sheet is contained in the sheet container 164.

A console 17 includes a control panel 171 and an operation portion 172. The control panel 171 shows settings, menus, and the like. The control panel 171 includes a touch panel to receive key inputs of a user or an operator. The operation portion 172 provides for the user ten keys to input various conditions related to the formation of an image, an instruction to start printing or copying, and the like.

Figure 2:
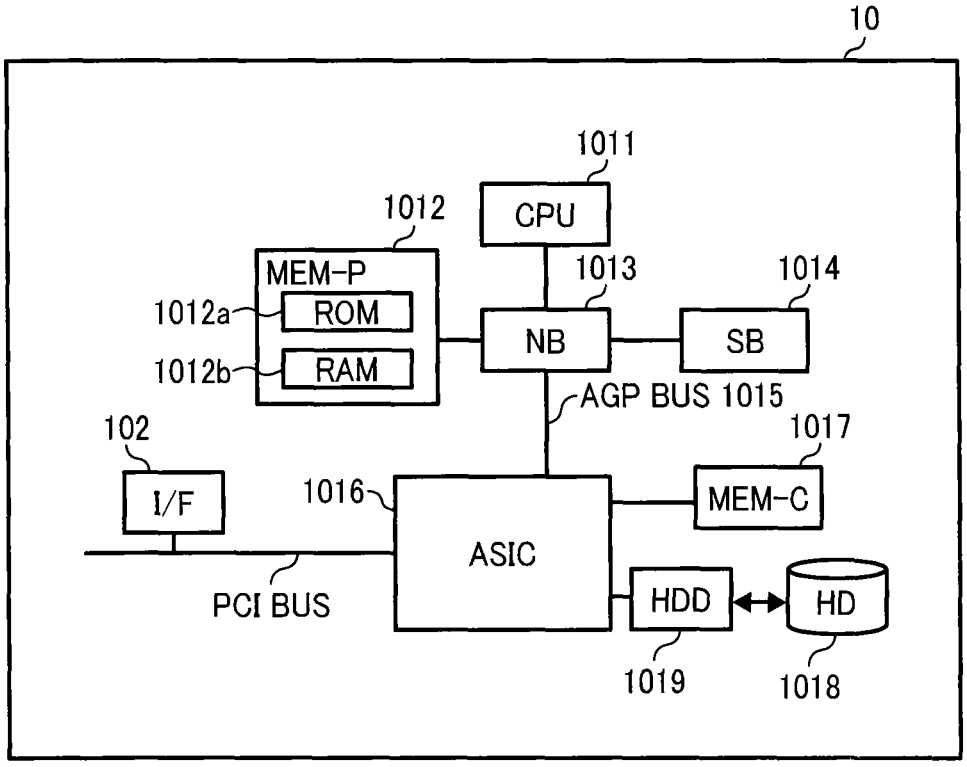
FIG. 2 illustrates a schematic configuration of a control unit of the image forming apparatus.

FIG. 2 illustrates a general outline of the control unit 10 of the image forming apparatus 1.

The control unit 10 includes, as illustrated in FIG. 2, a Central Processing Unit (CPU) 1011, a main memory (MEM-P) 1012, a north bridge (NB) 1013, a south bridge (SB) 1014, an Accelerated Graphic Port (AGP) bus 1015, an Application Specific Integrated Circuit (ASIC) 1016, a local memory (MEM-C) 1017, a hard disk (HD) 1018, a hard disk drive (HDD) 1019, and a network I/F 102.

The main memory 1012 stores programs and the CPU 1011 modifies or calculates data and controls on operations performed by the image reader 11, the image forming section 12, the sheet feeder section 13, the transfer section 14, the fixing section 15, and the discharging section 16 according to the programs stored. The main memory 1012 serves as a memory area of the control unit 10 and includes a Read Only Memory (ROM) 1012*a*, and a Random Access Memory (RAM) 1012*b*. The ROM 1012*a* stores programs and data to cause each device of the control unit 10 to work. These programs stored in the ROM 1012*a* can be recorded in computer readable recording media such as a CD-ROM, a flexible disk (FD), a CD-rewritable, and a Digital Versatile Disc (DVD) in the installable format or the executable format and can be offered.

The RAM 1012*b* is used as working memory when reading out programs and data and as a drawing memory when printing data stored in the memory. NB 1013 is a bridge to connect the CPU 1011 with the MEM-P 1012, SB 1014, and AGP bus 1015. The SB 1014 is a bridge to connect the NB 1013 with a Peripheral Component Interconnect (PCI) device and other peripheral devices. The AGP bus 1015 is a bus interface for a graphic accelerator card proposed to speed up the graphics operation.

The ASIC 1016 includes a PCI target and an AGP master, an arbiter (ARB) as a core of the ASIC 1016, a memory control circuit to control the MEM-C 1017, a plurality of Direct Memory Access Controllers (DMACs) to rotate image data using hardware logic. The ASIC 1016 is connected to a Universal Serial Bus (USB) interface or Institute of Electrical and Electronics Engineers (IEEE) 1394 interface via the PCI bus.

The MEM-C 1017 is a local memory used as an image buffer and code buffer for copying. The HD 1018 is a storage to store image data, font data used for printing, and various formats. The HDD 1019 controls reading and writing data to and from the HD 1018 under the control of the CPU 1011. A network interface (I/F) 102 transmits data to external devices such as an information processing device via a communication network.

Next, a toner feed connector will be described below.

Figure 3:
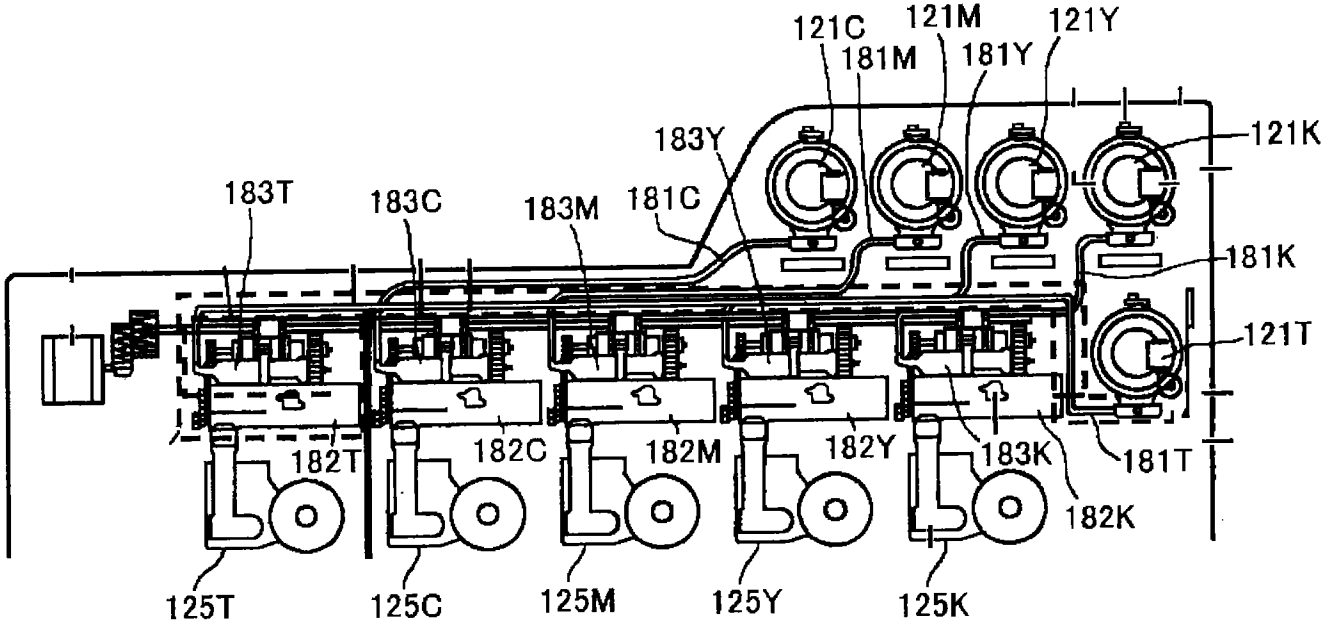
FIG. 3 illustrates a schematic configuration of a toner feed connector and its peripheral portion of the image forming apparatus.
Figure 4:
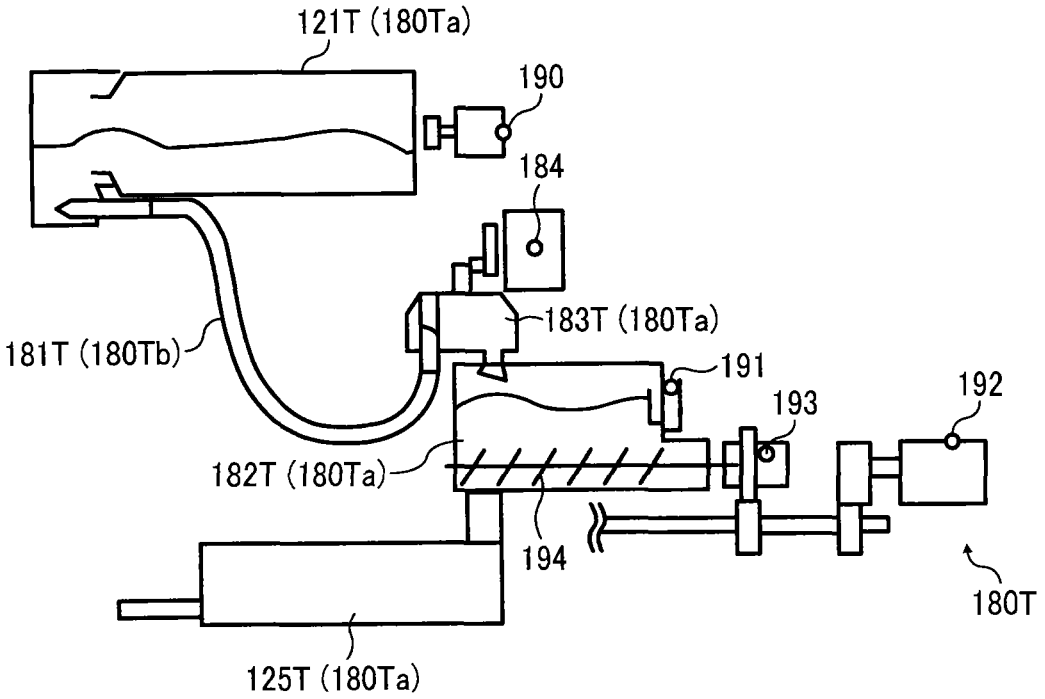
FIG. 4 illustrates a schematic configuration of the toner feed connector of a special color toner of the image forming apparatus.

FIG. 3 illustrates a schematic configuration of a toner feed connector of the image forming apparatus 1. FIG. 4 illustrates a schematic configuration of the toner feed connector of a special color toner of the image forming apparatus.

As illustrated in FIGS. 3 and 4, toner feed connectors 180C, 180M, 180Y, and 180K of the process color toner, and a toner feed connector 180T of the special color toner, are similarly configured and disposed. The toner feed connector 180T for the special color toner is taken as representative to describe the toner feed connector and illustration of the other toner feed connectors 180C, 180M, 180Y, and 180K are omitted.

As illustrated in FIG. 4, the toner feed connector 180T includes a supply tube 181T connected to the toner bottle 121T, a diaphragm pump 183T as a toner feeder, a sub hopper 182T as a temporary reservoir, and a developing device 125T. The structure of the toner feed connector 180T is not limited only to the above configuration.

The toner bottle 121T includes an internal conveyance screw disposed within the bottle. The conveyance screw is driven by a bottle drive motor 190. A toner sensor 191 is disposed to detect a toner amount inside the sub hopper 182T. When the toner sensor 191 detects that the toner amount inside the sub hopper 182T is less than a predetermined amount, the toner stored inside the toner bottle 121T is conveyed to the sub hopper 182T via the supply tube 181T. The diaphragm pump 183T for conveying the toner generates negative pressure from a diaphragm pump motor 184, thereby conveying the toner inside the toner bottle 121T to the sub hopper 182T.

The toner conveyed from the toner bottle 121T is stored inside the sub hopper 182T, and is conveyed as appropriate to the developing device 125T while being agitated by a supply screw 194. The supply screw 194 is driven by a supply motor 192 serving as a driving source via a clutch 193. The supply toner is conveyed to the developing device 125T, when, for example, the toner amount inside the developing device 125T is reduced below a threshold level.

It is noted that the lifetime of each part that forms the toner feed connector 180T, such as the toner bottle 121T and the developing device 125T, is different from part to part. As a result, because the conventional toner feed connector that is formed as a unit is replaced as a whole, the time of replacement is dictated by the part that has the shortest lifetime, resulting in poor cost performance.

By contrast, the toner feed connector 180T according to the present embodiment can be individually replaced as to all parts other than the supply tube 181T.

The toner bottle 121T can be detached from the image forming apparatus 1, by being pulled out from the image forming apparatus 1 by a user, and can be replaced with a new toner bottle 121T. The diaphragm pump 183T and the sub hopper 182T are integrally formed as an integrated unit. The integrated unit is attached to the image forming apparatus 1 with screws, and can be replaced by unscrewing it from the image forming apparatus 1. The developing device 125T is also detachably attachable to the image forming apparatus 1. The developing device 125T can be pulled out for replacement from the image forming apparatus 1 along slide rails.

As described above, each constituent part can be individually replaced according to its proper lifetime, with better cost performance than the conventional toner feed connector.

When a different type of toner is used in the image forming unit 120T, to prevent unwanted mixing of colors, the constituent parts including the toner bottle 121T, the diaphragm pump 183T, the sub hopper 182T, and the developing device 125T should be replaced. For convenience in explanation, each constituent part requiring replacement is defined as a first toner feed connector 180Ta. In addition, a not-to-be-replaced constituent part other than the first toner feed connector 180Ta is defined as a second toner feed connector 180Tb.

Because the lifetime of the supply tube 181T is substantially equal to or longer than that of the image forming apparatus, the supply tube 181T is included in the second toner feed connector 180Tb that is not to be replaced, according to the present embodiment. However, when, for example, the first toner feed connector 180Ta is replaced due to the application for the clear toner to the white toner, the clear toner stored in the supply tube 181T and the white toner inside the replaced toner bottle 121 mix if any countermeasure is not done for preventing unwanted mixing of colors. Thus, when the toner bottle 121T is replaced with another bottle for a different type of toner, the supply tube 181T should be cleaned with any cleaner.

Cleaning of the supply tube 181T is performed by aspirating the toner remaining inside the supply tube 181T from one end of the supply tube 181T by a cleaner with both ends of the supply tube 181T not connecting to anything. But the cleaner is not limited only to this configuration. For example, air is sent from one end of the supply tube 181T by a fan, thereby forcibly discharging the residual toner from another end of the supply tube 181T. In addition, the cleaner is not always mounted to the image forming apparatus 1, but the cleaner disposed outside the apparatus 1 can be used for the time of cleaning.

At least one end of the supply tube 181T is preferably directed upward in a vertical direction when mounted on the image forming apparatus 1. In the cleaning process, the residual toner is to be discharged from the end of the supply tube 181T directed vertically upward, so that the toner inside the supply tube 181T is prevented from falling down into the image forming apparatus.

The supply tube 181T can be set to the first toner feed connector 180Ta. A direct toner supply method is a method to supply the toner directly from the toner bottle 121T to the developing device 125T without passing through the toner feed connector 180T. In this case, when the toner different from the toner used in the image forming unit 120T is used, the toner bottle 121T alone may be replaced.

Detection of attachment/detachment status of the toner bottle and of identification data will be described below. The term "identification data" used herein means data related to the toner type included in the toner bottle and the data related to a maintenance contract of the toner bottle.

Figure 5:
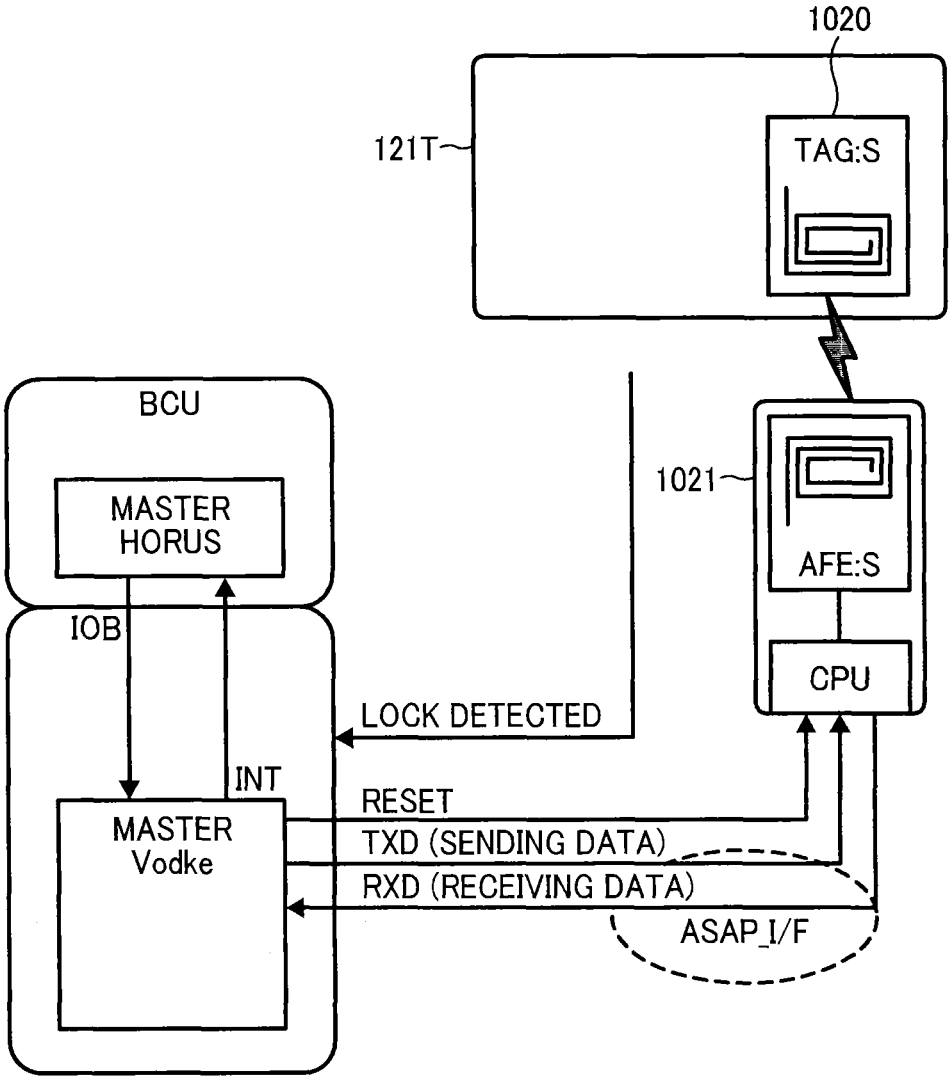
FIG. 5 illustrates an attachment/detachment status detector of an image forming unit for the special color toner, a toner type detector, and a maintenance contract detector in the image forming apparatus.

FIG. 5 is a view illustrating detection of the attachment/detachment status and identification data of the image forming unit 120T of the special color toner.

As illustrated in FIG. 5, the toner bottle 121T includes a Radio Frequency IDentification (RFID) tag 1020, as an information storage medium. An access terminal 1021 includes an analog front-end (AFE) that includes an antenna and a modem IC of 1ch, and a CPU. The access terminal 101 communicates with the RFID tag 1020 attached to the toner bottle 121T to thereby detect the data stored in the RFID tag 1020.

Commands/data are transmitted between the AFE and the CPU. The AFE ASK-modifies the command/data and reads or writes the RFID tag 1020. Further, the CPU analyses the ASAP command and performs data code conversion (Mirror code conversion). Between the CPU and the image forming apparatus (BCU/IOB), commands/data are transmitted via ASP_I/F via TXD (input data) and RXD (output data). A reset (RESET) command from the apparatus resets the CPU.

The CPU 1011 as a determiner (see FIG. 2) determines attachment/detachment status of the toner bottle 121T based on the presence or absence of the transmitted data between the RFID tag 1020 and the access terminal 1021. In the present embodiment, detection of the attachment and detachment status is determined by the presence or absence of the transmitted data from the RFID tag 1020; however, the configuration is not limited only to this. For example, an attachment/detachment status of the toner bottle 121T can be detected by the CPU 1011 that makes a determination based on the presence/absence of the connection between the toner bottle 121T and the connector disposed on the image forming apparatus.

The CPU 1011 determines the toner type and the maintenance contract status of the toner bottle 121T based on the identification data held by the RFID tag 1020 detected through the access terminal 1021. The communication data from the RFID tag 1020 attached to the toner bottle 121T can be stored in the main memory 1012. In this case, the CPU 1011 can determine the toner type of the toner bottle from the data stored in the main memory 1012.

The detection of the identification data is not limited only to the above configuration using the RFID tag 1020. For example, the CPU 1011 can determine the toner type as follows: A projection is formed on a different position of the toner bottle 121T depending on each toner type and each individual contract status data, and an optical sensor detects the position of the projection with the toner bottle 121T attached to the image forming apparatus, so that the CPU 1011 can determined the toner type.

Alternatively, the toner type can be recognized by a user who uses a detector to read a two-dimensional code such as a QR (registered trademark) code disposed on the toner bottle 121T.

As described above, the attachment/detachment status of the toner bottle, the toner type, and the maintenance contract status can be detected from a common structure, thereby improving the cost performance of the image forming apparatus.

Further, the attachment/detachment status and the identification data such as toner type information can be detected as to all the constituent elements (that is, the toner bottle 121T, the toner feed connector 180T, and/or the developing device 125T) classified as the first toner feed connector 180Ta. For example, the RFID tag 1020 as an information storage device is attached to all the elements classified as the first toner feed connector 180Ta. Thus, as to all the elements classified as the first toner feed connector 180Ta, the attachment/detachment status and the identification data such as the toner type information can be detected similarly to the case of the toner bottle 121T.

Herein, an activation process of a RFID tag 1020 attached to a toner bottle 121T will be described. When the RFID tag 1020 is attached to each constituent element of the first toner feed connector 180Ta, the activation process of the RFID tag 1020 is the same as that for the RFID tag 1020 attached to the toner bottle 121T.

Figure 6:
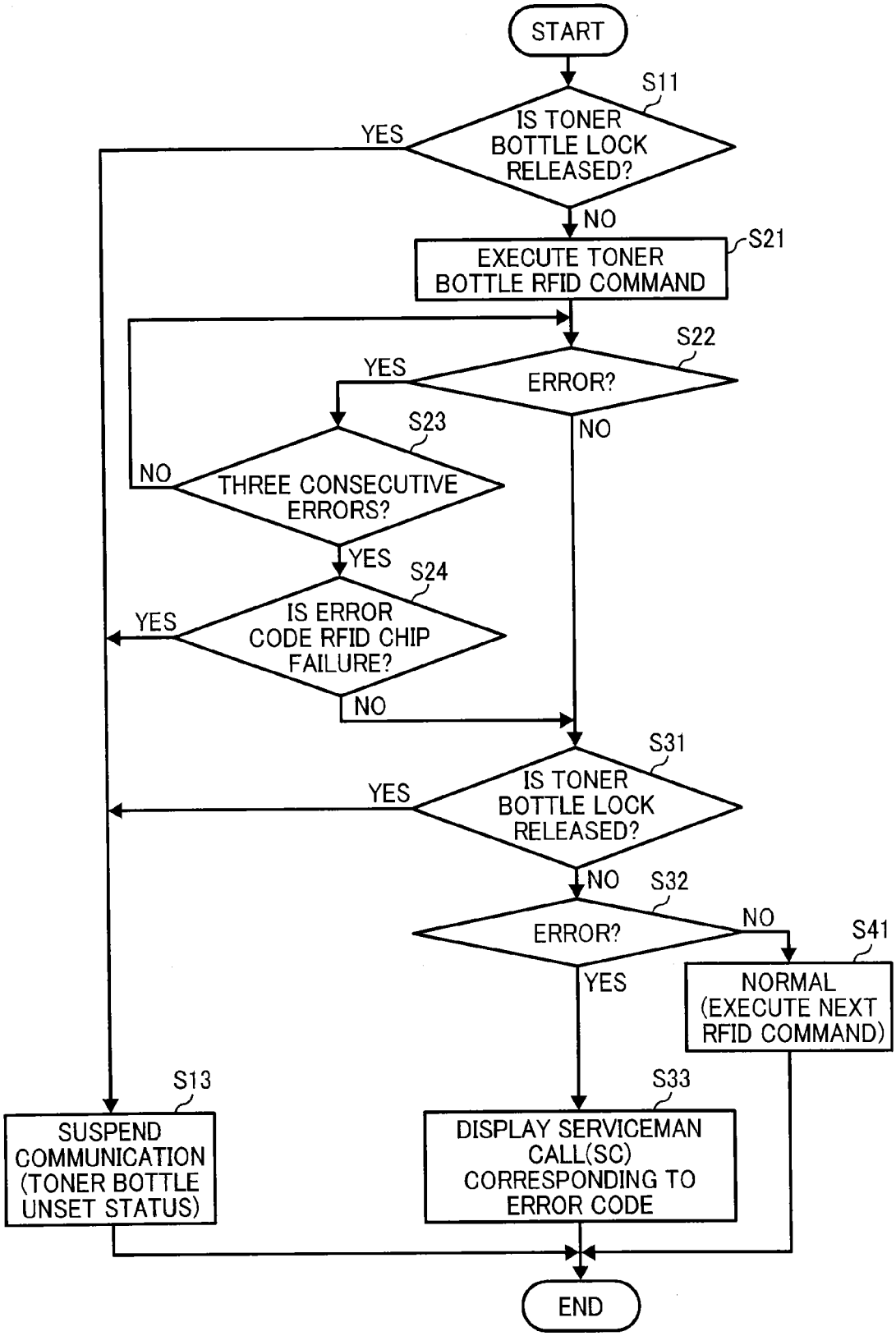
FIG. 6 is a flowchart illustrating an activation process of a RFID tag attached to a toner bottle in the image forming apparatus.

FIG. 6 is a flowchart illustrating an activation flow of the RFID tag 1020 attached to the toner bottle 121T.

An activation system of the RFID tag 1020 is started and RFID communication is started. In step S11, it is determined whether or not the toner bottle lock detection sensor has released the lock of the toner bottle 121T. When it is detected in step S11 that the toner bottle lock detection sensor has released the lock of the toner bottle 121T, the process proceeds to step S13. In step S13, communication is suspended and the control panel 171 displays "toner bottle unset." Subsequently, the process proceeds to step S14 and the RFID communication ends.

On the other hand, when it is determined that the toner bottle lock detection sensor has not released the lock of the toner bottle 121T, the process proceeds to step S21. In step S21, the toner bottle RFID command is executed. Next, it is determined whether or not an error occurred in step S22.

When it is determined in step S22 that the error occurred, the process proceeds to step S23. In step S23, it is determined whether or not three consecutive errors have occurred. In step S23, if it is determined that three consecutive errors did not occur, the process returns to step S22. On the other hand, when errors occur consecutively three times in step S23, the process proceeds to step S24. In step S24, whether or not the error is due to failure of the RFID chip is determined. When it is determined in step S24 that the error is due to failure of the RFID chip, the process proceeds to step S13. In step S13, the communication is suspended and the control panel 171 displays "toner bottle unset". Then, the RFID communication ends.

On the other hand, when it is determined that the error is not due to the failure of the RFID chip, the process proceeds to step S31. In step S31, whether or not the toner bottle lock detection sensor has released the lock of the toner bottle 121T is determined. When it is determined in step S31 that the toner bottle lock detection sensor has released the lock of the toner bottle 121T, the process proceeds to step S13. In step S13, the communication is suspended and the control panel 171 displays "toner bottle unset". Then, the RFID communication ends.

On the other hand, when it is determined in step S31 that the toner bottle lock detection sensor has not released the lock of the toner bottle 121T, the process proceeds to step S32. In step S32, whether the error has occurred or not is determined. When it is determined that the error has occurred in step S32, the process proceeds to step S33. In step S33, the control panel 171 displays "serviceman call (SC)" corresponding to the error occurred. Then, the RFID communication ends.

On the other hand, if it is determined in step S32 that no error has occurred, the process proceeds to step S41. In step S41, the control panel 171 displays "normal". Then, the RFID communication ends.

When it is determined in step S22 that no error has occurred, the process proceeds to step S31 and the process from S31 to the process end is executed.

When a toner bottle based on the maintenance contract different from that of the image forming apparatus is used, a certain problem will occur, which will be described below.

The types of maintenance contract for the image forming apparatus include a charge contract, copy kit contract, and spot contract. The charge contract is a maintenance contract, in which copying fee is charged based on the number of prints copied or printed. The charge contract includes a toner use fee, so that the user does not need to buy the toner bottle. The copy kit contract includes the toner bottle fee and the maintenance service fee as a set that are bought by the user as a whole. In the copy kit contract, the maintenance service can be offered during the use of the toner bottle. The spot contract excludes the above maintenance contract, and the support is offered with a charge each time the maintenance service is needed.

Toner bottles are commercially available, but when, for example, the charge contract is concluded for the image forming apparatus, the user does not need to buy the toner bottle. As described above, the charge contract means a maintenance contract, in which copying fee is charged based on the number of prints copied, and the charged fee includes the toner use fee. On the other hand, if the type of contract that the user concludes for the image forming apparatus does not include a supply of the toner bottle, or when the user does not conclude the maintenance contract and receives only the stop maintenance, the user has to buy the toner bottle.

Suppose that there is a plurality of image forming apparatuses in one office and some are based on the charge contract and the others are based on the spot contract. In such a case, the user can remove the toner bottle from the charge contract apparatus and attach it to the spot contract apparatus. Then, because the spot contract apparatus is not charged based on the printed number of prints, the toner inside the toner bottle for the charge contract apparatus is used without being charged. Therefore, the maintenance services provider to offer maintenance services and supply toner bottles based on the maintenance contract suffers a disadvantage.

By recognizing the type of the maintenance contract of the toner bottle 121T, the maintenance contract of the toner bottle 121T and the maintenance contract of the image forming apparatus 1 are cross-checked, so that use of the toner bottle 121T can be determined, thereby preventing the maintenance services providers from suffering the disadvantage described above.

The unwanted mixing of colors that happens to occur when a toner bottle is replaced from a toner type that has been used immediately before to a different toner type and when the toner feed connector is the same, will be described below.

When the toner bottle is replaced to a type of toner different from the type of the toner that has been used immediately before, the constituent elements of the toner feed connector should be cleaned or replaced entirely to prevent the unwanted mixing of colors. However, when the user starts to use the apparatus without noticing that fact, the unwanted mixing of colors occurs.

As described above, because the toner type of the toner bottle 121T is recognizable, it can be determined whether or not the toner type of the toner bottle 121T is the same as that of the toner bottle 121T that has been used immediately before (i.e., toner type difference determination). With this scheme, the unwanted mixing of colors due to human error such as starting the use of the image forming apparatus 1 without replacing the constituent elements of the toner feed connector 180T, can be prevented. A process of the toner type difference determination will be described later.

Figure 7:
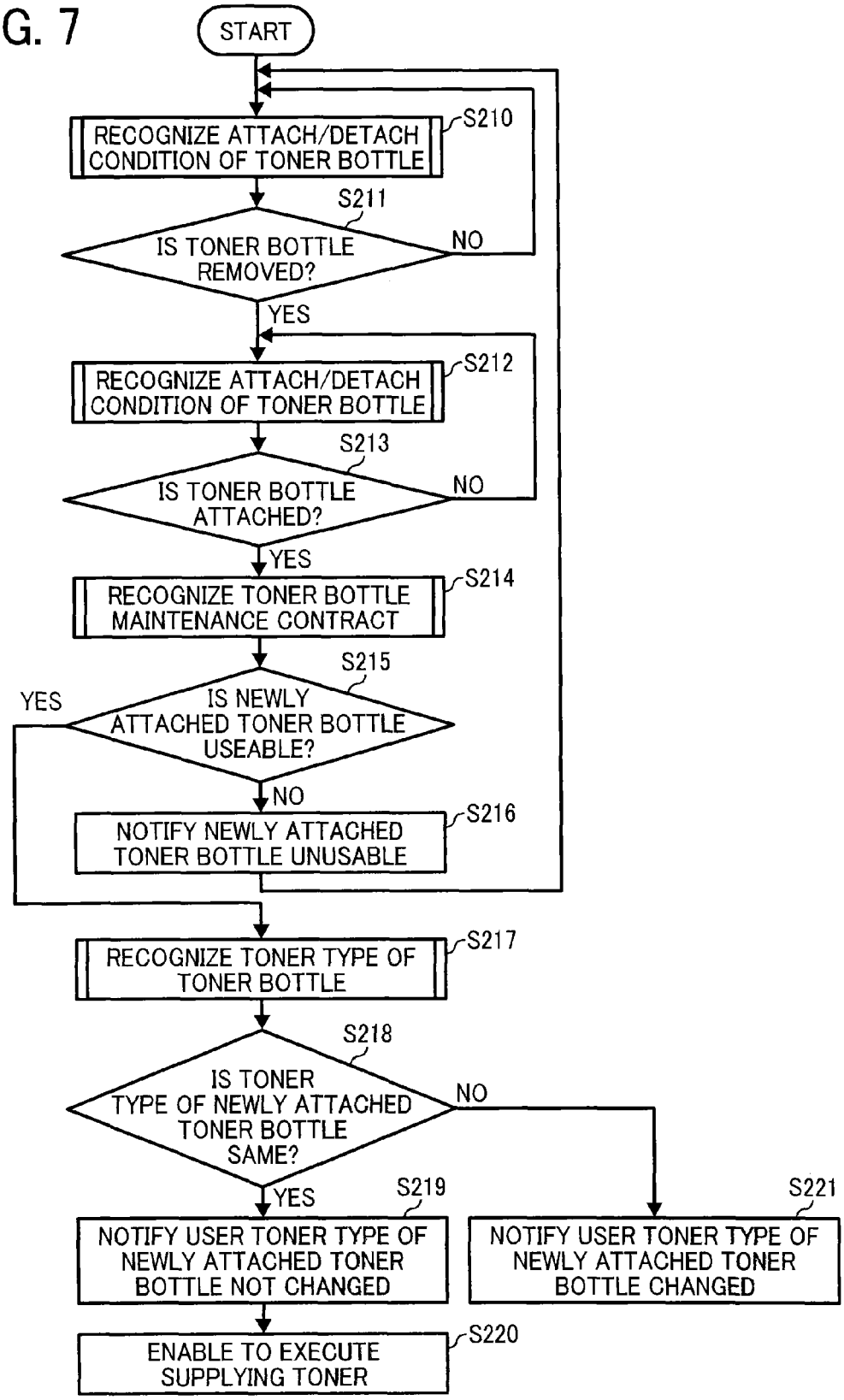
FIG. 7 is a flowchart illustrating an exemplary process of determining usability of toner bottle and identification of toner type in the image forming apparatus.

FIG. 7 is a flowchart illustrating an exemplary process of determining a usability of toner bottle and an identification of toner type.

First, a replacement of the toner bottle 121T is started and the process proceeds to a subroutine of recognizing an attachment/detachment status of the toner bottle 121T, which will be described later.

In step S211, the CPU 1011 determines whether or not the toner bottle 121T is removed. When it is determined in step S211 that the toner bottle 121T is not removed, the process returns to step S210. On the other hand, if it is determined in step S211 that the toner bottle 121T is removed, the process proceeds to step S212. In step S212, the process proceeds to the subroutine of recognizing an attachment/detachment status of the toner bottle 121T and performs the process.

In step S213 that follows step S212, the CPU 1011 determines whether or not the toner bottle 121T is attached. When it is determined in step S213 that the toner bottle 121T is not attached, the process returns to step S212. When it is determined in step S213 that the toner bottle 121T is attached, the process proceeds to step S214.

In step S214, the process proceeds to a subroutine of recognizing a maintenance contract of the newly attached toner bottle 121T and performs the process. The subroutine of recognizing the maintenance contract will be described later.

Next, in step S215, the CPU 1011 cross-checks the maintenance contract of the newly attached toner bottle 121T recognized in the recognizing process of the maintenance contract and the maintenance contract of the image forming apparatus stored in the main memory 1012, and determines whether or not the newly attached toner bottle 121T is useable. The determination of whether the toner bottle 121T is useable or not is performed based on the toner use determination table in Table 1. As depicted in Table 1, when the maintenance contract of the image forming apparatus is based on the charge contract, it is determined any of the toner bottle depending on the charge contract, the toner bottle depending on the copy kit contract, and the toner bottle depending on the spot contract is useable. By contrast, when the maintenance contract of the image forming apparatus is based on the copy kit contract, it is determined that the toner bottle depending on the copy kit contract alone is useable. In addition, when the maintenance contract of the image forming apparatus is based on the spot contract, it is determined that the toner bottle depending on the spot contract alone is useable.

TABLE 1

| | | Image forming apparatus Maintenance contract | | |
|---|---|---|---|---|
| Toner bottle | | Charge contract | Copy kit contract | Spot contract |
| Maintenance contract | Charge contract | Usable | Unusable | Unusable |
| | Copy kit contract | Usable | Usable | Unusable |
| | Spot contract | Usable | Unusable | Usable |

Figure 10:
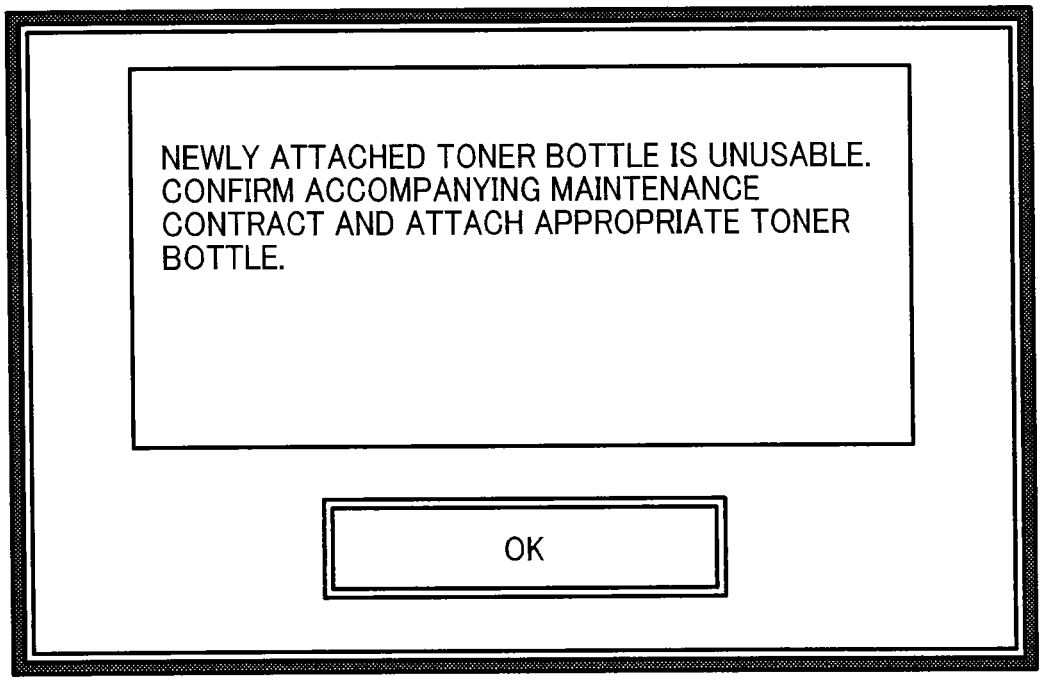
FIG. 10 illustrates an exemplary display indicating that the attached toner bottle in the image forming apparatus cannot be used.

When it is determined in step S215 that the toner bottle 121T is not useable, the process proceeds to step S216. In step S216, that the newly attached toner bottle 121T is not useable is notified. This notification is executed by displaying a banner or a window on the control panel 171 as illustrated in FIG. 10. After the step S216, the process returns to step S210.

When it is determined in step S215 that the toner bottle 121T is useable, the process proceeds to step S217. In step S217, the process proceeds to a subroutine of recognizing a toner type as to the newly attached toner bottle 121T and performs the process. The subroutine of recognizing the toner type will be described later. Next, in step S218, it is determined whether or not the toner type of the toner bottle 121T is changed before and after the replacement. Specifically, the CPU 1011 determines whether or not the toner type of the newly attached toner bottle 121T recognized in the recognition process of the toner type and the toner type stored in the main memory 1012 are the same. It is noted that the toner type stored in the main memory 1012 is the toner type of the toner bottle 121T that has been used immediately before.

Figure 11A:
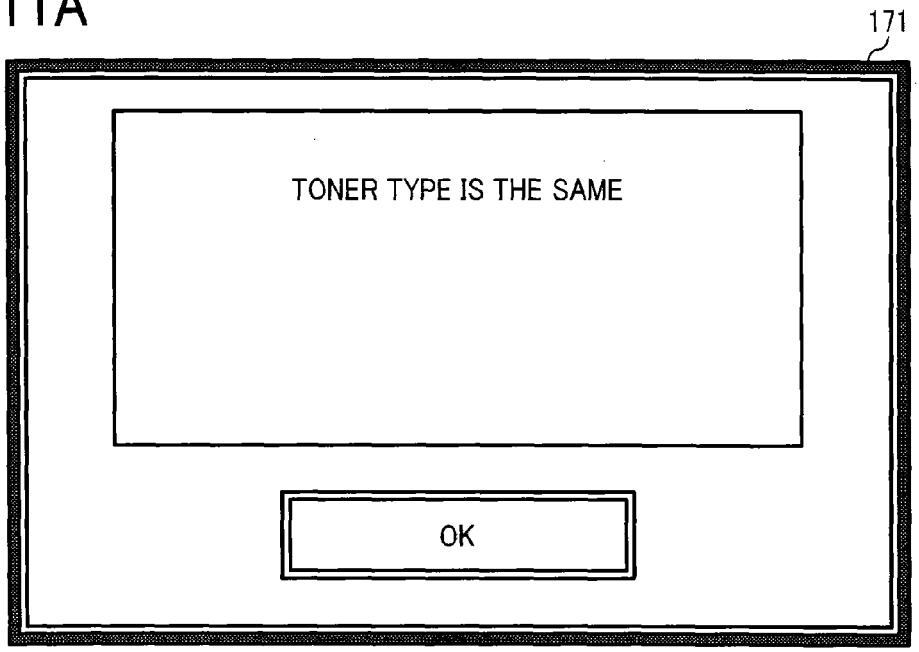
FIGS. 11A to 11C illustrate exemplary displays indicating whether the type of the attached toner bottle in the image forming apparatus is the same as the one being replaced or not.

When it is determined in step S218 that the toner type of the toner bottle 121T is the same before and after the replacement, the process proceeds to step S219. In step S219, that the toner type of the toner bottle 121T is the same is notified to the user. This notification is executed by displaying a banner or a window on the control panel 171 as illustrated in FIG. 11A. Subsequently, in step S220, supplying toner from the toner bottle 121T is enabled.

Figure 11B:
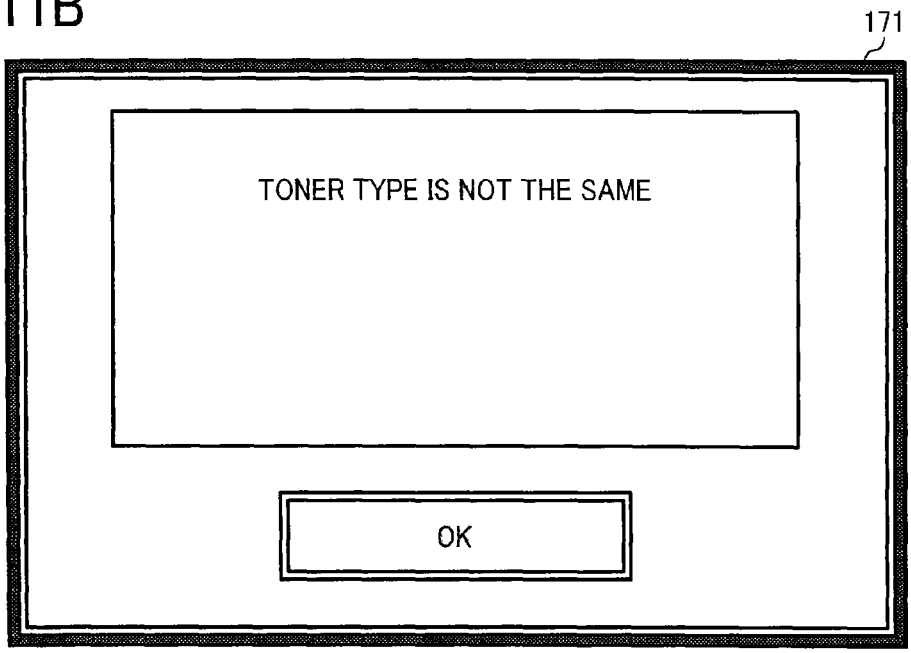
Figure 11C:
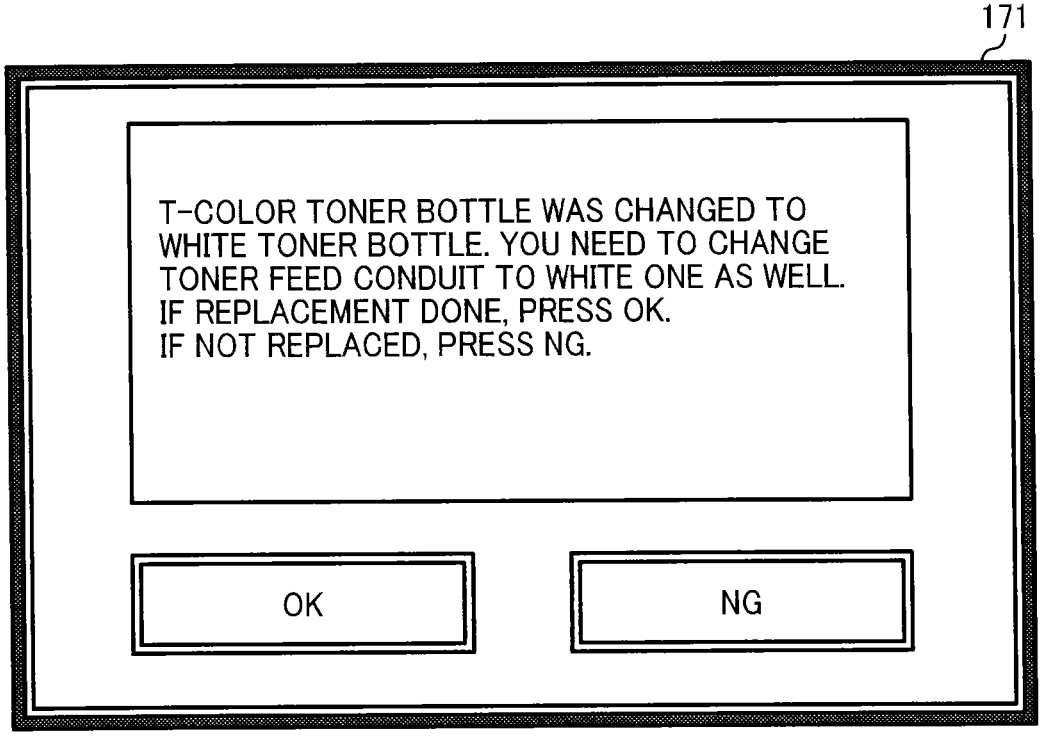

On the other hand, when it is determined in step S218 that the toner type of the toner bottle 121T is not the same before and after the replacement, the process proceeds to step S221. In step S221, that the toner type of the toner bottle 121T is not the same is notified. This notification is executed by displaying a banner or a window on the control panel 171 as illustrated in FIG. 11B. For example, when the toner bottle 121T for the clear toner is changed to the toner bottle for the white toner, the display shows that T-color toner bottle was changed to white-color toner bottle as illustrated in FIG. 11C. The display may further show, "You need to change the toner feed connector to white-color one as well. If replacement done, press OK. If not replaced, press NG."

The flow of recognizing the attachment/detachment status of the toner bottle 121T in above step S210 and S212 will be described (see FIG. 7).

Figure 8:
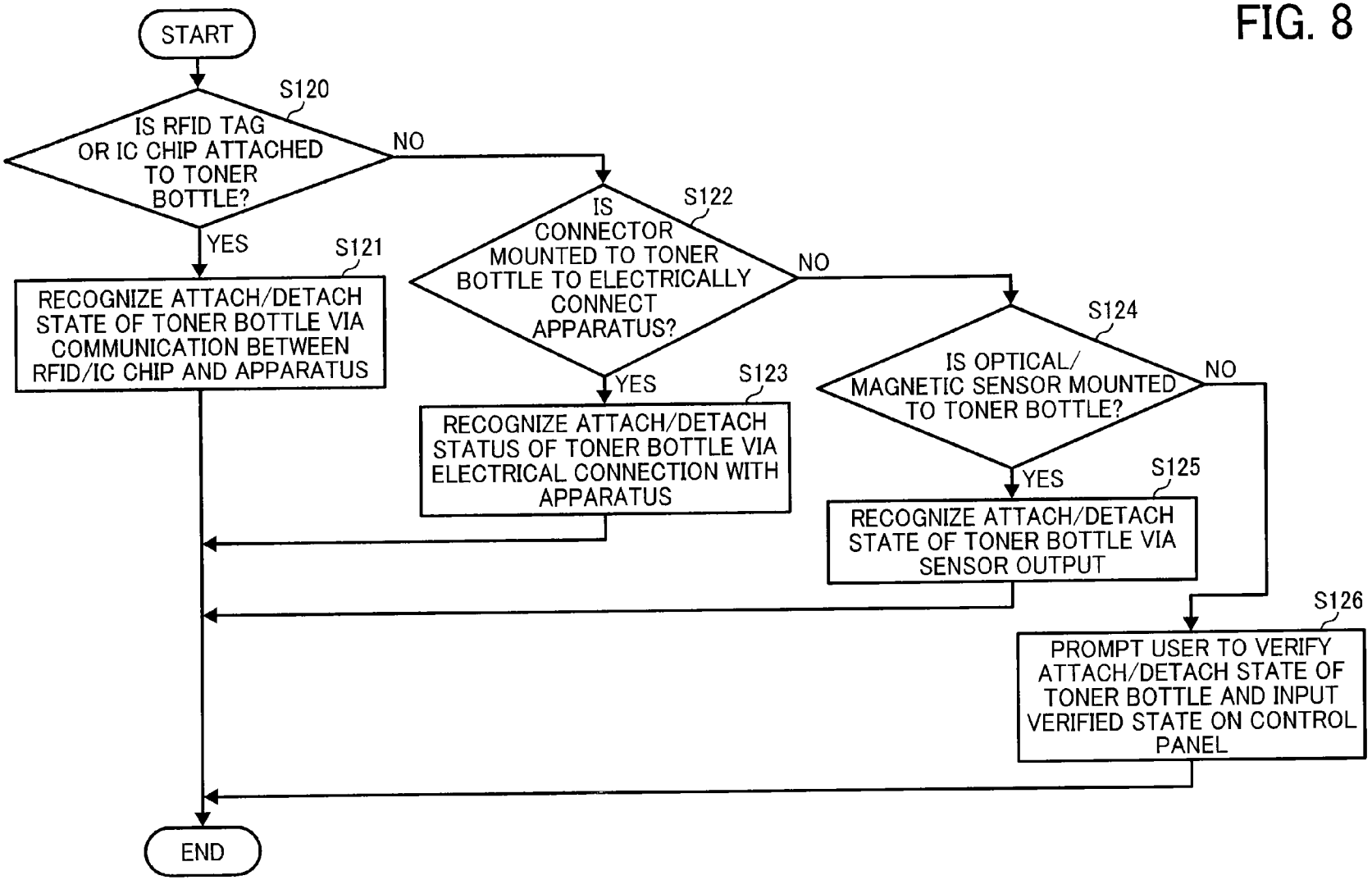
FIG. 8 is a flowchart illustrating an exemplary subroutine of a process of recognizing attachment/detachment of the toner bottle in the image forming apparatus.

FIG. 8 is a flowchart illustrating an exemplary subroutine of a process of recognizing attachment/detachment of the toner bottle 121T.

First, in step S120, the CPU 1011 determines whether or not a RFID tag or IC tag is attached to the toner bottle 121T. When it is determined in step S120 that the RFID tag or the IC tag is attached to the toner bottle 121T, the process proceeds to step S121. In step S121, the CPU 1011 recognizes a status of attachment/detachment of the toner bottle 121T via a communication between the RFID tag or the IC tag and the image forming apparatus. Thereafter, a subroutine has been complete, and the process returns to a main flow.

When it is determined in step S120 that the RFID tag or the IC tag is not attached to the toner bottle 121T, the process proceeds to step S122. In step S122, the CPU 1011 determines whether or not a connector to electrically connect the image forming apparatus is mounted to the toner bottle 121T. When the CPU 1011 determines that the connector to electrically connect the image forming apparatus is mounted to the toner bottle 121T, the process proceeds to step S123. In step S123, the CPU 1011 recognizes a status of attachment/detachment of the toner bottle 121T via an electrical connection of the connector with the image forming apparatus. Thereafter, a subroutine has been complete, and the process returns to a main flow.

When the CPU 1011 determines in step S122 that the connector to electrically connect the image forming apparatus is not mounted to the toner bottle 121T, the process proceeds to step S124. In step S124, the CPU 1011 determines whether or not an optical sensor or magnetic sensor is attached to the toner bottle 121T. In step S124, when the CPU 1011 determines that the optical sensor or magnetic sensor is attached to the toner bottle 121T, the process proceeds to the step S125. In step S125, the CPU 1011 recognizes a status of attachment/detachment of the toner bottle 121T based on outputs from the mounted optical sensor or magnetic sensor. Thereafter, a subroutine has been complete, and the process returns to a main flow.

When the CPU 1011 determines in step S122 that the optical sensor or magnetic sensor is not attached to the toner bottle 121T, the process proceeds to the step S126. In step S126, a message to prompt a user to verify attachment/detachment status of the toner bottle 121T is displayed on the control panel 171. Against the display, the user inputs the attachment/detachment status of the toner bottle 121T that has been verified by human eyes, on the control panel 171. The CPU 1011 ends the subroutine on receipt of the input information, and the process proceeds to the main flow.

When the attachment/detachment status of each constituent element of the first toner feed connector 180Ta is allowed to be recognized, the attachment/detachment recognition process of each constituent element is performed similarly to the attachment/detachment recognition process for the toner bottle 121T as described above.

The flow of recognizing the maintenance contract of the toner bottle 121T in step S214 (see FIG. 7) and recognizing the toner type of the toner bottle 121T in step S217 (see FIG. 7) will be described.

Figure 9:
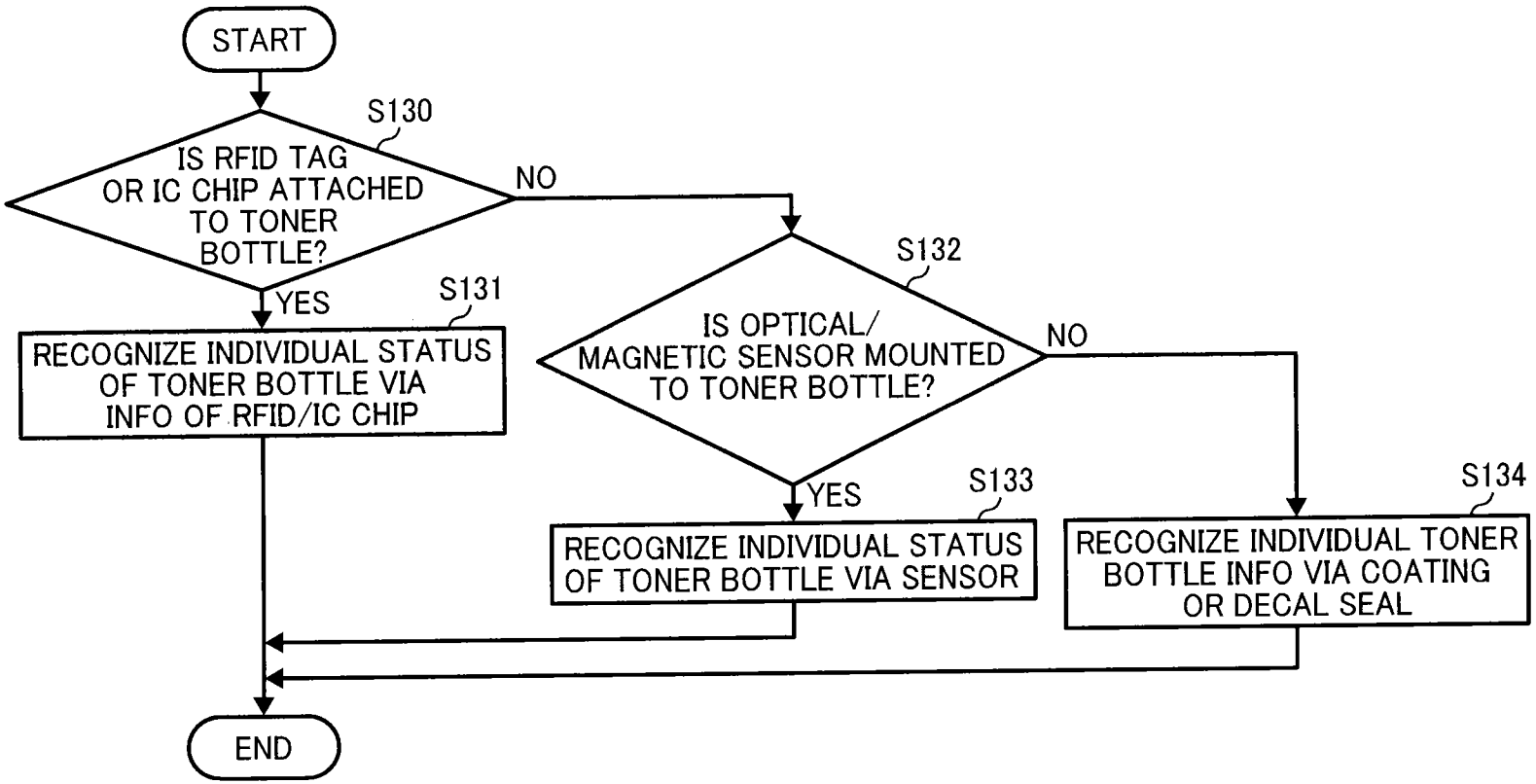
FIG. 9 is a flowchart illustrating an exemplary subroutine of a process of recognizing a maintenance contract status and the toner type of the toner bottle in the image forming apparatus.

FIG. 9 is a flowchart illustrating an exemplary subroutine of a process of recognizing the maintenance contract and the toner type of the toner bottle 121T. Either flow of the recognizing process is similar to each other. In the following description, information on the toner bottle 121T includes information on the maintenance contract and the toner type of the toner bottle 121T.

First, in step S130, the CPU 1011 starts recognizing information on the toner bottle 121T and determines whether or not a RFID tag or IC tag is attached to the toner bottle 121T. When it is determined in step S130 that the RFID tag or the IC tag is attached to the toner bottle 121T, the process proceeds to step S131. In step S131, the CPU 1011 recognizes information on the toner bottle 121T based on the information from the RFID tag or the IC tag. Upon the subroutine has been complete, the process returns to a main flow.

When it is determined in step S130 that the RFID tag or the IC tag is not attached to the toner bottle 121T, the process proceeds to step S132. In step S132, the CPU 1011 determines whether or not an optical sensor or magnetic sensor is attached to the toner bottle 121T. When the CPU 1011 determines that the optical sensor or magnetic sensor is attached to the toner bottle 121T in step S132, the process proceeds to the step S133. In step S133, the CPU 1011 recognizes information on the toner bottle 121T based on outputs from the mounted optical sensor or magnetic sensor. For example, as described above, the CPU 1011 recognizes information on the toner bottle 121T by that the optical sensor detects the position of the projection formed at a different position of the toner bottle 121T depending on the toner type. Upon the subroutine has been complete, the process returns to a main flow.

When the CPU 1011 determines in step S132 that the optical sensor or magnetic sensor is attached to the toner bottle 121T, the process proceeds to the step S134. In step S134, an image reader disposed in the image forming apparatus reads identification information such as coating or a decal sheet, and the CPU 1011 ends the subroutine and the process returns to the main flow.

When the toner type can be detected as to each constituent element of the first toner feed connector 180Ta, the recognizing process of the toner type of these constituent elements can be performed based on the same flow performed in recognizing information on the toner bottle 121T. (It is noted that the maintenance contract as to the constituent element other than the toner bottle 121T is not performed.)

The aforementioned embodiments are examples and specific effects can be obtained for each of the following aspects of (A) to (D):

Aspect A

An image forming apparatus includes a developing device such as the developing device 125 to develop, with toner, a latent image on the latent image bearer such as the photoconductor drum 122; a toner container such as a toner bottle 121 to contain toner to supply to the developing device 125; a connector such as a supply tube 181 to guide the toner of the toner container such as the toner bottle 121 to the developing device 125, in which the toner container is detachably attachable to the apparatus. The image forming apparatus further includes information detector such as an access terminal 1021 to detect information including toner type information and maintenance contract information stored in the toner container; a determiner such as the CPU 1011 to determine whether or not the toner type information of the toner containers coincides before and after the replacement and whether the maintenance contact information of the toner container is matched with maintenance contact information of the image forming apparatus; and a notifier such as a control panel 171 to indicate a determination made by the determiner, in which the CPU 1011 serves as a controller to cause the information detector to perform detection, and the determiner to perform determination, and the notifier to notify, when a new toner container is attached.

Because the information detector is provided, the maintenance contract and the toner type of the toner container can be detected. Once the toner container is attached, it is configured such that the toner type information of the toner container is detected, and whether or not the attached toner container is the same or not can be determined. The notifier indicates the determination result, so that the unwanted mixing of colors caused by human error can be prevented. Human error may include performing image forming operation without replacing the connector or the developing device required when the toner type is different.

Aspect B

In Aspect A, the toner container includes a memory to store the information such as a RFID tag 1020 in which the maintenance contract information of the image forming apparatus is pre-recorded and the toner type information of the toner contained in the toner container is stored, in which determination as to whether or not the toner container coincide to the maintenance contract of the apparatus is performed by cross-checking the maintenance contract of the apparatus and that of the toner container, and determination of necessity of replacement of the developing device and the connector is performed by cross-checking the toner type information stored in the memory device and the detected toner type information.

Aspect C

In either Aspect A or B, the notifier includes a display such as a control panel 171, visible to the eye.

Aspect D

In any one of Aspect A to C, the developing device and the connector each include an information storage medium such as a RFID tag 1020 to store the toner type information for use, respectively; the information detector detects the toner type information stored in the information storage medium of each of the developing device and the toner feed connector when the toner container is attached to the image forming apparatus; the processor cross-checks the toner type information stored in each of the developing device and the connector and the toner type information stored in the toner container; and the notifier indicates the cross-checked result.

Additional modifications and variations of the present invention are possible in light of the above teachings. It is therefore to be understood that, within the scope of the appended claims, the invention may be practiced other than as specifically described herein.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. An image forming apparatus comprising:

a latent image bearer;

a developing device to develop, with toner, a latent image on the latent image bearer;

a toner container that contains the toner, the toner container being detachably attachable to the image forming apparatus;

a toner feed connector to guide the toner of the toner container to the developing device;

an information detector to detect identification information including toner type information and maintenance contract information which indicates a fee type for forming images using the toner, stored in the toner container;

a processor to determine whether the toner type information of the toner container coincides before and after replacement and whether the maintenance contract information of the toner container is matched with maintenance contract information of the image forming apparatus; and a notifier to indicate a determination made by the processor.

2. The image forming apparatus as claimed in claim 1, wherein the processor causes the information detector to perform detection, and the notifier to indicate the determination, when the toner container is attached to the image forming apparatus.

3. The image forming apparatus as claimed in claim 1, further comprising a memory to store the maintenance contract information of the image forming apparatus and the toner type information of the toner container, and wherein the toner container includes an information storage medium to store the identification information.

4. The image forming apparatus as claimed in claim 3, wherein the processor executes the determination as to whether the toner container is matched with the maintenance contract of the image forming apparatus by cross-checking the maintenance contract information of the image forming apparatus stored in the memory and the maintenance contract information stored in the information storage medium of the toner container.

5. The image forming apparatus as claimed in claim 4, wherein the processor determines necessity of replacement of the developing device and the toner feed connector by cross-checking the toner type information stored in the memory and the toner type information stored in the information storage medium and detected with the information detector.

6. The image forming apparatus as claimed in claim 1, wherein the notifier includes a display to display the determination made by the processor.

7. The image forming apparatus as claimed in claim 1, wherein:

the developing device and the toner feed connector each include an information storage medium to store toner type information for use;

the information detector detects the toner type information stored in the information storage medium of each of the developing device and the toner feed connector when the toner container is attached to the image forming apparatus;

the processor cross-checks the toner type information stored in each of the developing device and the toner feed connector and the toner type information stored in the toner container; and the notifier indicates a cross-checked result from the processor.

8. The image forming apparatus as claimed in claim 1, wherein:

the maintenance contract information indicates a charge contract in which is a charge based on a number of images formed and the charge includes a toner use fee.

9. The image forming apparatus as claimed in claim 1, wherein:

the maintenance contract information indicates a spot contract in which there is no charge based on toner consumed for images which are formed.

10. An image forming apparatus comprising:

a latent image bearer;

a developing device to develop, with toner, a latent image on the latent image bearer;

a toner container that contains the toner, the toner container being detachably attachable to the image forming apparatus;

a toner feeder to supply the toner to the developing device;

an information detector to read toner type information and maintenance contract information of the toner container which indicates a fee type for forming images using the toner; and wherein the toner feeder supplies the toner when the toner type information of the toner container coincides before and after replacement and the maintenance contract information of the toner container is matched with maintenance contract information of the image forming apparatus.

11. The image forming apparatus as claimed in claim 10, wherein:

the maintenance contract information indicates a charge contract in which is a charge based on a number of images formed and the charge includes a toner use fee.

12. The image forming apparatus as claimed in claim 10, wherein:

the maintenance contract information indicates a spot contract in which there is no charge based on toner consumed for images which are formed.

* * * * *